US006553196B2

(12) United States Patent
Inoue

(10) Patent No.: US 6,553,196 B2
(45) Date of Patent: Apr. 22, 2003

(54) IMAGE FORMING APPARATUS

(75) Inventor: Ryo Inoue, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,356

(22) Filed: Sep. 7, 2001

(65) Prior Publication Data

US 2002/0031371 A1 Mar. 14, 2002

(30) Foreign Application Priority Data

Sep. 12, 2000 (JP) ..... 2000-276930

(51) Int. Cl.[7] ..... G03G 15/00; G03G 21/08
(52) U.S. Cl. ..... 399/128
(58) Field of Search ..... 399/128, 127, 399/43; 430/902

(56) References Cited

U.S. PATENT DOCUMENTS

| | | | | |
|---|---|---|---|---|
| 2,956,487 A | | 10/1960 | Giaimo, Jr. | 399/46 |
| 4,674,865 A | | 6/1987 | Tada et al. | 399/102 |
| 5,809,379 A | | 9/1998 | Yano et al. | 399/159 |
| 6,208,820 B1 | * | 3/2001 | Nami | 399/128 |
| 6,240,269 B1 | * | 5/2001 | Kaya et al. | 399/127 |

FOREIGN PATENT DOCUMENTS

| | | | |
|---|---|---|---|
| JP | 61-34578 | | 2/1986 |
| JP | 61-100780 | | 5/1986 |
| JP | 1-34205 | | 10/1989 |
| JP | 6-3921 | | 1/1994 |
| JP | 2000-181159 | * | 6/2000 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus capable of making potential control executable immediately after starting copying and shortening a first copying time includes a photosensitive drum (1), a charging magnetic brush charger (2) for charging the photosensitive drum (1) and a main electricity eliminating light irradiating apparatus (8) for irradiating light to eliminate a light memory in the photosensitive drum 1. The main electricity eliminating light irradiating apparatus (8) irradiates the photosensitive drum (1) with an exposure amount larger than a minimum exposure amount for eliminating a light memory in at least a part of an irradiation process.

20 Claims, 6 Drawing Sheets

IMAGE FORMING APPARATUS

BACKGROUND OF THE INVENTION

1. Field of the Invention

The present invention relates to an image forming apparatus such as a copying machine and a printer, and more particularly, to an image forming apparatus that irradiates light on a photosensitive member in order to remove charge from it.

2. Description of the Related Art

Conventionally, an image forming apparatus employing an electrophotographic method is an apparatus employing a method and having a configuration in which a first image bearing member is caused to form and bear a transferable image by an appropriate image forming process; the transferable image is transferred from the first image bearing member to a second image bearing member; and the first image bearing member is repeatedly used for successive image formation.

For example, an image forming apparatus such as a copying machine and a laser beam printer is basically provided with an electrophotographic photosensitive member, which is generally a rotary drum, as the first image bearing member and charging means for uniformly charging the surface of the rotating photosensitive member to a predetermined polarity and potential.

Moreover, the image forming apparatus is provided with image exposing means for forming an electrostatic latent image on a charge processing surface of the rotating photosensitive member, developing means for developing the electrostatic latent image as a toner image and transferring means for transferring the toner image from the surface of the photosensitive member to a transfer paper as the second image bearing member (recording material).

Moreover, the image forming apparatus is provided with fixing means for fixing the toner image transferred to the transfer paper as a permanently fixed image and photosensitive member cleaning means (cleaner) for eliminating transferred residual toner on the surface of the rotating photosensitive member after the toner image has been transferred to the transfer paper so as to clean the surface of the photosensitive member.

The transfer paper to which image fixing processing is applied by the fixing means is discharged as an image formed product (copy or print).

The surface of the photosensitive member cleaned by the cleaning means is served for image formation repeatedly.

As a photosensitive member to be used for a conventional image forming apparatus of the electrophotographic method or the electrostatic recording method, a selenium series photosensitive member, an amorphous silicon (hereinafter referred to as a-Si) photosensitive member, an organic photosensitive member and the like are put to practical use. It is known that, among the photosensitive members, the a-Si photosensitive member is particularly excellent in terms of stability and durability.

The a-Si photosensitive member tends to absorb moisture because the surface of the photosensitive member becomes sensitive to humidity due to influence of a corona product caused by ozone that is generated from a back charger having a surface of high hardness This becomes a cause of drift of charge on the surface of the photosensitive member and brings about degradation of an image quality called a smeared image.

In order to prevent such a smeared image, various methods are used such as a method of heating with a heater described in Japanese Utility Model Examined Publication No. Hei 1-34205, a method of eliminating a corona product by rubbing a surface of a photosensitive drum by a brush formed of a magnet roller and magnetic toner described in Japanese Patent Examined Publication No. Hei 2-38956, and a method of eliminating a corona product by rubbing a surface of a photosensitive member by an elastic roller as described in Japanese Patent Application Laid-open No. Sho 61-100780.

On the other hand, contact charging is being put to practical use instead of corona charging as a charging method.

Contact charging is a method for charging the photosensitive member as a member to be charged to a predetermined polarity and potential of the surface of the photosensitive member by applying a predetermined charging bias to a conductive charging member such as a roller (charging roller), a fur brush, a magnetic brush or a blade and the like, and has advantages in that less ozone is generated and electric power consumption is small compared with the corona charging device.

Two types of charging methods, a corona charging method and a contact injection charging method, are mixed in a charging mechanism (charging principle) of the contact charging type, and respective properties emerge depending on which one is dominant.

The corona charging method uses a discharge phenomenon, such as corona discharge that occurs in a micro space between a contact charging member and a member to be charged, to charge the member to be charged by a discharge product. The corona charging method still generates a small amount of ozone, although it is markedly less than that in the case of the corona charger.

The contact injection charging method is a method in which charge is directly injected in a member to be charged from a contact charging member, whereby the surface of the member to be charged is charged.

This is also referred to as direct charging or injection charging. Japanese Patent Application Laid-open No. Hei 6-3921 and the like proposes a method of performing contact injection charging by injecting charge into a trap level existing on a surface of a photosensitive member or charge holding member, such as conductive particles and the like of a charge injection layer, using a contact charging member such as a charging roller, a fur brush or a magnetic brush and the like, in which conductive magnetic particles are magnetically constrained. Since contact injection charging does not use the discharge phenomenon, only a portion where the member to be charged and the charging member contact each other is charged.

Therefore, it is desirable to make peripheral speed differences or moving directions opposite each other in the charging member and the member to be charged so as to have a sufficiently high possibility of contact between the member to be charged and the charging member in order to perform fine charging without charging unevenly.

In addition, contact injection charging is a low power and ozoneless charging method in which there is no threshold voltage for starting charging and a voltage required for charging is only for a desired surface potential of a photosensitive member.

As a member to be charged for which the contact injection charging can be used, it is necessary to provide a charging injection layer in which conductive particulates as a charge holding member are dispersed on a surface of a photosensitive layer, for example, in the case of an organic photosensitive member. However, in the case of an inorganic photosensitive member represented by an a-Si photosensitive member, many trap levels based on a defect of a crystal exist on its surface even if a charge injection layer is not specifically provided, whereby injected charge is held by the trap levels and the injection charging can be applied to it.

Since contact injection charging does not generate a discharge product at all, if an a-Si photosensitive member is combined with the contact injection charging, there is a large advantage in that a smeared image that is a drawback of the a-Si photosensitive member can be fundamentally solved.

Therefore, it is unnecessary to provide means for always heating the a-Si photosensitive member with a heater or rubbing the surface of the photosensitive member with magnetic particles or an elastic member, whereby saving of power consumption and simplification of an apparatus can be realized.

However, the a-Si photosensitive member has such a characteristic that, if a light irradiated region and a dark region are simultaneously charged, attenuation (dark attenuation) of a potential is extremely large in the light irradiated region compared with the dark region, and a light memory (after image phenomenon) tends to occur.

That is, an a-Si series photosensitive member has many dangling bonds, which turn into localized levels that tend to trap a part of light carriers and lower its running performance or lower a recombination possibility of optically generated carriers.

Therefore, in the image forming process, a part of the light carriers generated by exposure is released from the localized level simultaneously when an electric field is applied to the a-Si series photosensitive member at the time of charging in the next step and a difference of surface potentials of the a-Si series photosensitive member occurs between an exposing portion and an unexposed portion, which eventually emerges as a smeared image due to a light memory.

Therefore, it is generally practiced to perform equal exposure in a main electricity eliminating process, thereby making light carriers latent inside the a-Si series photosensitive member excessive and equal/uniform over the entire surface so as to eliminate the light memory.

Thus, the light memory can be eliminated more effectively by increasing an amount of main electricity eliminating light emitted from a main electricity eliminating light source or by making a wavelength of the main electricity eliminating light close to a peak of spectral sensitivity (approximately 600 to 700 nm) of the a-Si series photosensitive member.

In a-Si, dark attenuation due to thermally generated carriers cannot be neglected and a potential tends to fluctuate due to temperature as well. Thus, image deterioration due to environmental fluctuation is prevented by using a potential stabilization technique as described below in addition to temperature control of a photosensitive member.

U.S. Pat. No. 2,956,487 discloses a method of measuring a latent potential of a photosensitive member by a potential sensor or sensing an image density developed on an electrostatic latent image and feeding a sensing signal back to charging means and image forming and exposing means of the image forming process to control them such that a desired potential can be obtained, thereby stabilizing an electronic photographic image. Such an image stabilizing method is generally performed when a power source is input to an apparatus or an image forming process is started or completed.

However, the conventional technology as described above has the following problems. In the case of a photosensitive member having many localized levels working as an electron trap like the a-Si, since accumulation of light carriers due to main electricity eliminating light progresses after starting image formation, a phenomenon of decreasing potential occurs.

The light carriers which are trapped enter a steady state while the charging process is repeated, and a potential is gradually stabilized. However, while a potential is decreasing, since the image formation cannot enter a step of potential control, there is a problem in that a first copying time is naturally extended.

Further, a state in which a potential is stabilized means that a balance among generation and accumulation of light carriers by main electricity eliminating light and recombination of light carriers or extinction of light carriers by emitting carriers trapped by charging becomes steady. The state varies according to an amount of light, a wavelength or a charging voltage.

SUMMARY OF THE INVENTION

The present invention has been devised in view of the above and other drawbacks, and it is an object of the present invention to provide an image forming apparatus capable of making potential control executable immediately after starting copying and shortening a first copying time.

It is another object of the present invention to provide an image forming apparatus having a photosensitive member; charging means for charging the photosensitive member; exposing means for exposing the photosensitive member charged by the charging means in order to form a latent image on the photosensitive member; and light irradiating means for irradiating light on the photosensitive member in order to eliminate a light memory of the photosensitive member, wherein the light irradiating means irradiates the photosensitive member with an amount of light larger than a minimum amount of light for eliminating a light memory in at least a part of an irradiation process.

Other objects and features of the present invention will be apparent from the following description of the preferred embodiments taken in conjunction with the accompanying drawings.

DETAILED DESCRIPTION OF THE PREFERRED EMBODIMENTS

Figure 1:
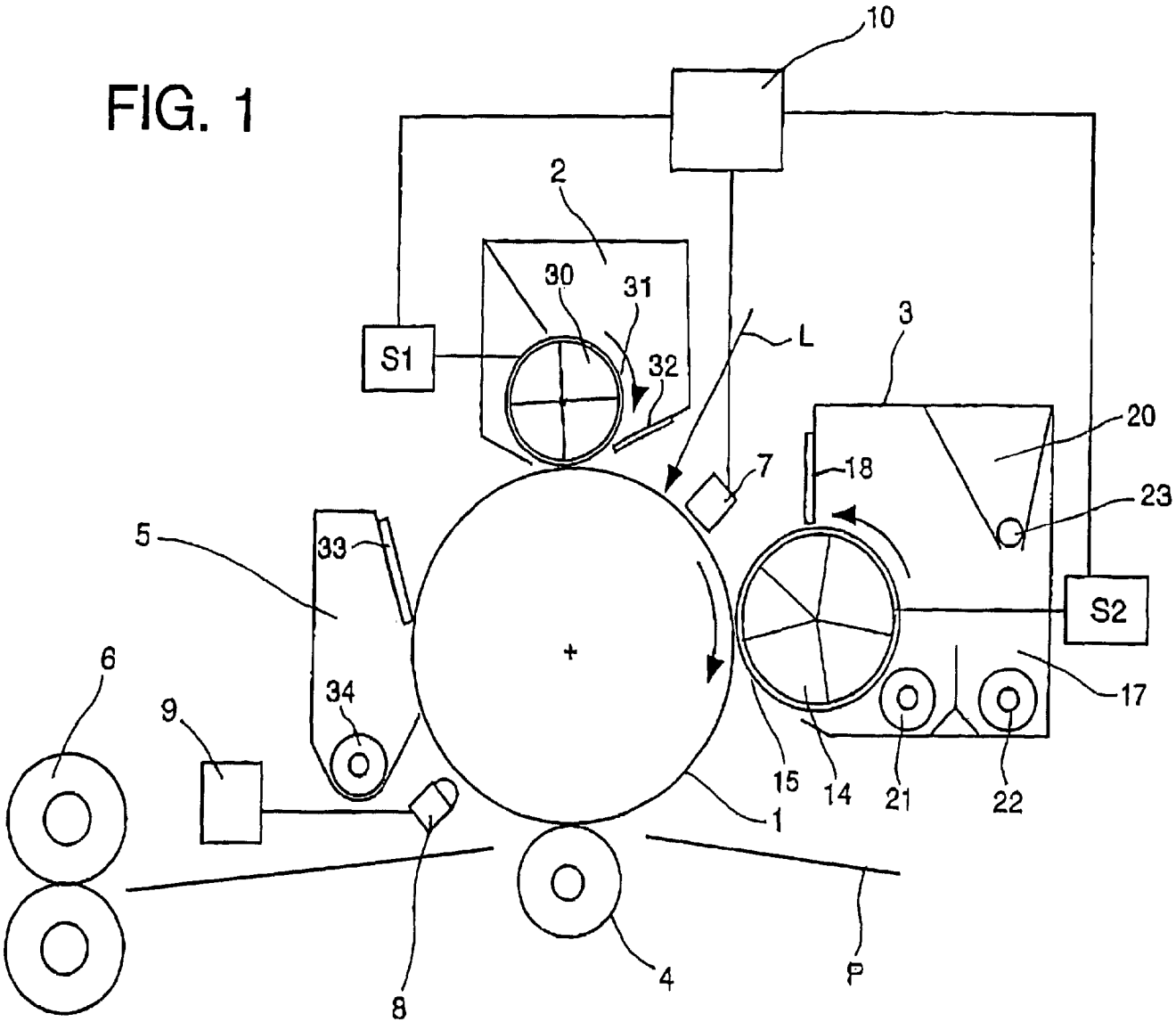
FIG. 1 is a schematic side view of a first embodiment of an image forming apparatus in accordance with the present invention.

Preferred embodiments of the present invention will be hereinafter described in detail with reference to the accompanying drawings. Further, dimensions, materials and shapes of components and their relative arrangements and the like described in the embodiments are not intended to limit the scope of the present invention to them only unless specifically described otherwise.

In addition, in the accompanying drawings, like reference numerals designate the same or similar parts throughout the figures thereof.

First Embodiment

First, a first embodiment of an image forming apparatus in accordance with the present invention will be described with reference to. FIG. 1. FIG. 1 is a schematic side view of the first embodiment of the image forming apparatus in accordance with the present invention.

Reference numeral 1 denotes a cylindrical photosensitive drum (photosensitive member) made of a-Si (an image bearing member), which is an element of the present invention and rotates in the direction indicated by an arrow at the speed of 150 mm/sec. Reference numeral 2 denotes a magnetic brush charger of a charge injection method using a magnetic brush as charging means, which is an element of the present invention, and 3 denotes a developing unit for forming a toner image corresponding to an electrostatic latent image formed by irradiating a laser beam L on the photosensitive drum 1.

Reference numeral 4 is a transfer roller for electrostatically transferring the toner image formed on the photosensitive drum 1 to a transfer material P, which is a recording material, 5 denotes a cleaner for collecting transfer residual toner remaining on the photosensitive drum 1 after the transfer process, and 6 denotes a fixing unit for thermally fixing the toner on the transfer material.

Reference numeral 7 denotes a potential sensor for sensing a potential on the photosensitive drum 1 and 8 denotes a main electricity eliminating light irradiating apparatus, as electricity eliminating light irradiating means, for eliminating a residual potential on the photosensitive drum 1 after transfer.

Reference numeral 9 denotes a control apparatus for controlling an amount of light of the main electricity eliminating light irradiating apparatus 8, S1 denotes a power source for applying a charging voltage to the charger 2, S2 denotes a power source for applying a developing bias, and 10 denotes a controlling apparatus for changing an output value of 51 and S2 based on a measurement value of the potential sensor 7.

In the above-mentioned configuration, the process of charging, exposure, development, transfer, fixing and cleaning are repeated based on a well-known electrophotographic process.

In this embodiment, a charging voltage to be applied to the magnetic brush charger 2 is controlled based on a potential measured by the potential sensor 7 in this process.

In this embodiment, an initial potential control is performed upon inputting a power source in the apparatus to set a charging potential and a development potential and correction of a potential is performed in forming an image, whereby potential fluctuation due to change of temperature in the apparatus during standby is corrected.

A process of controlling the initial potential will be described. First, charging voltages are set at predetermined Vh and Vl, and a photosensitive drum potential is measured by applying image exposures $L_{OO}$ and $L_{FF}$ to the photosensitive drum at the time of the respective charging voltages An $L_{OO}$ curve and an $L_{FF}$ curve of the photosensitive drum potential with respect to the charging voltages are determined based on the value.

With a curve obtained by deducting a predetermined constant from the $L_{OO}$ curve as an $L_{CONT}$ curve, a charging voltage value and a developing direct current voltage value are calculated such that an appropriate contrast potential is obtained from a difference between the $L_{CONT}$ curve and the $L_{FF}$ curve.

In the correction of a potential, a photosensitive drum potential at the time of the potential control and a photosensitive drum potential when an image formation starting instruction is received are compared, and the charging voltage is corrected from the difference.

Figure 2:
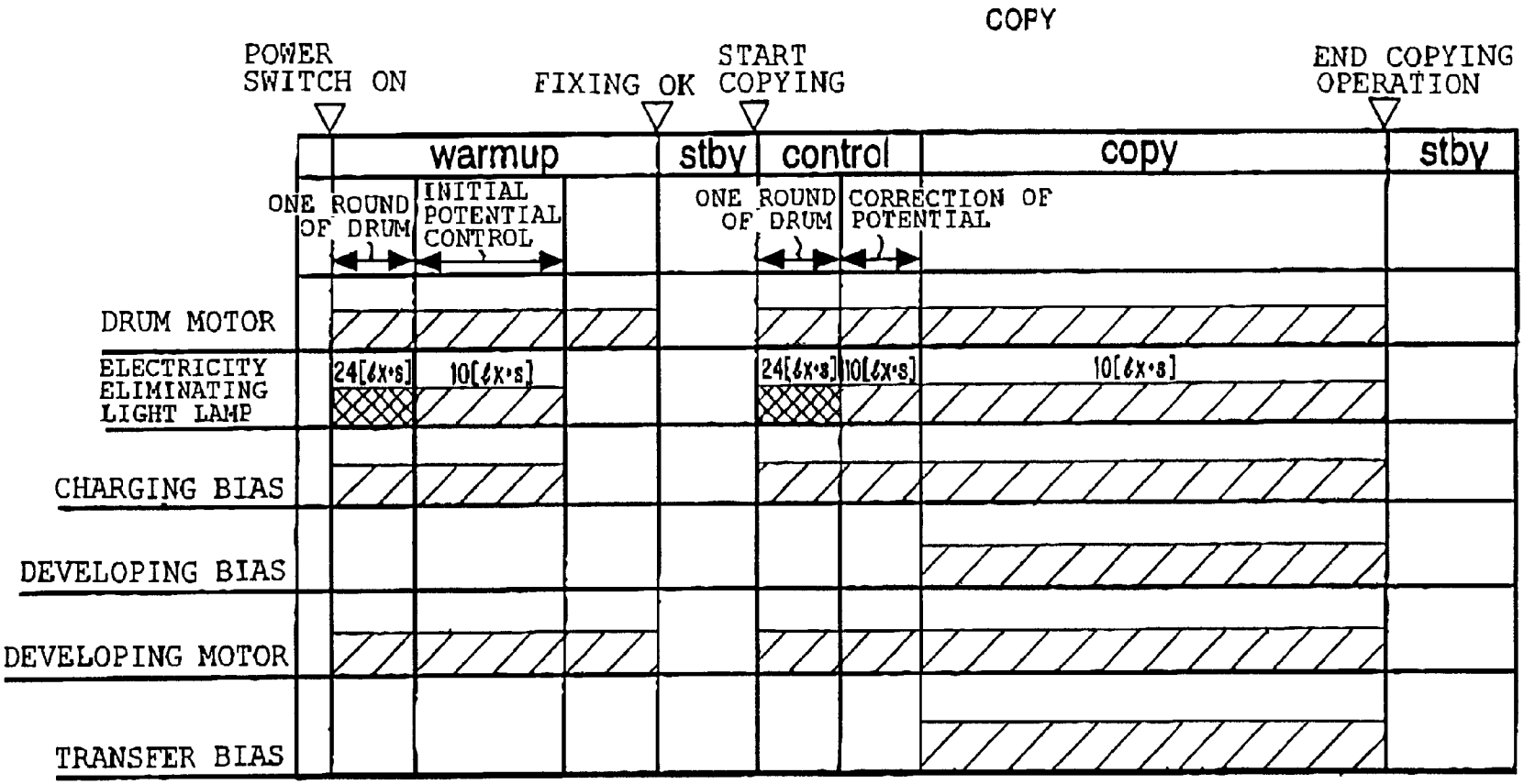
FIG. 2 is an operational sequence diagram of the image forming apparatus shown in FIG. 1.

An image forming sequence of this embodiment is shown in, FIG. 2. FIG. 2 is an operational sequence diagram of the image forming apparatus shown in FIG. 1.

When the power source of the apparatus is turned on, heating of the fixing unit 6 is started and simultaneously and initial potential control is performed. At this point, a charging bias is on and the main electricity eliminating light irradiating apparatus (electricity eliminating light lamp) 8 emits light with a predetermined amount of light 10 [1x·s] at an image formation period.

Here, as a process prior to entering the initial potential control, the charging bias is turned on and the main electricity eliminating light irradiating apparatus 8 emits light with an amount of light 24 [1x·s], which is higher than that during image formation, for one round of the photosensitive drum.

Thus, a highly accurate potential control becomes possible with the potential of the photosensitive drum stabilized. When the temperature of the fixing unit 6 reaches a predetermined temperature, the fixing unit 6 enters a standby state.

Further, upon receiving an instruction to start image formation, the main electricity eliminating light irradiating apparatus 8 emits light with the amount of light 24 [1x·s], which is higher than that during image formation, for only one round of the photosensitive drum as at the time of the potential control. Thereafter, the amount of light changes to the predetermined amount of light 10 [1x·s] at the image formation period and the correction of a potential is performed.

Thus, the process enters image formation with the photosensitive drum potential and the developing contrast controlled to appropriate amounts It is needless to mention that the above-mentioned amount of light is not limited to 10 [1x·s] or 24 [1x·s] and, in particular, a high output amount of light may not be 24 [1x·s] as long as it is an exposure amount larger than a minimum exposure amount for eliminating a light memory. In addition, a period for emitting light with a high amount of light is not limited to a period for one round of the drum and may be a longer period.

The potential control process of this embodiment will be described in detail next. A potential of the photosensitive drum should be stabilized in order to perform potential control with of high accuracy.

Figure 3:
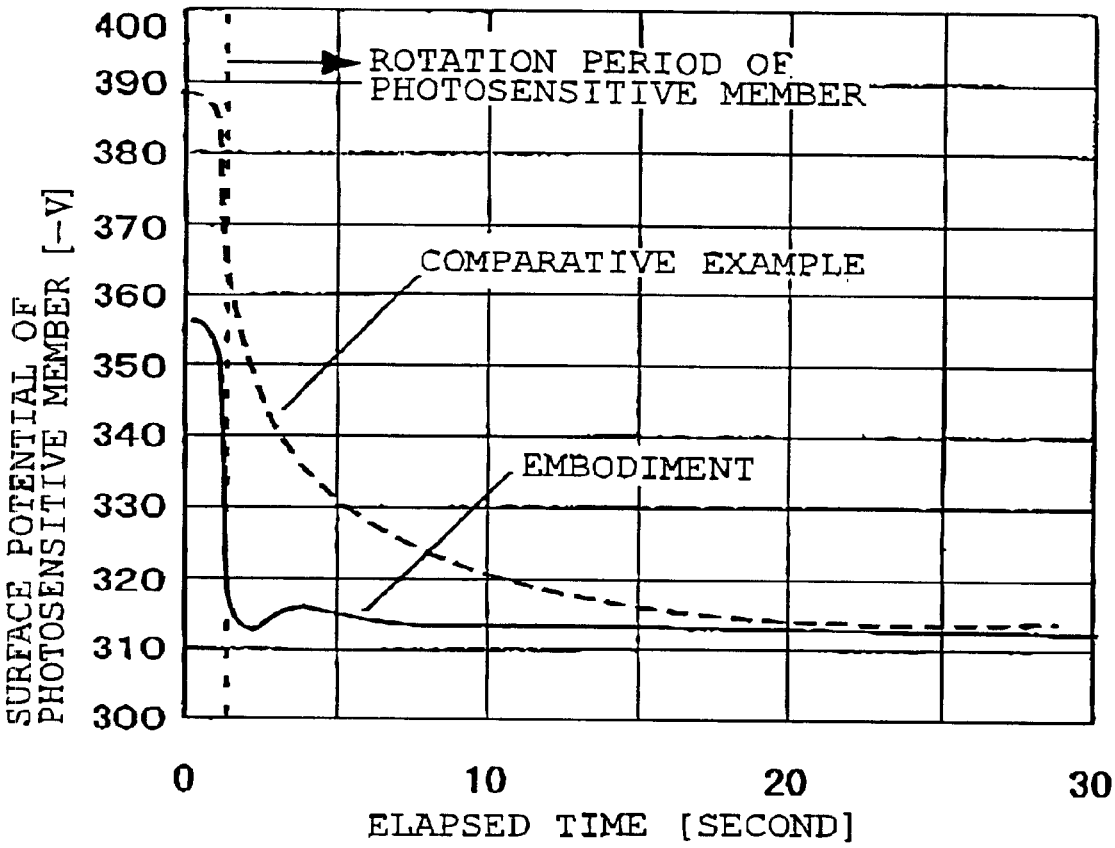
FIG. 3 is a graph of transition of surface potentials of photosensitive drums in the image forming apparatus shown in FIG. 1 and a conventional image forming apparatus.

However, a photosensitive drum including many electron traps in a photosensitive layer, which is represented by an a-Si photosensitive drum, shows an initial charging property as shown in a comparative example of FIG. 3 for the purpose of accumulating light carriers. FIG. 3 is a graph of transition of surface potentials of photosensitive drums in the image forming apparatus shown in FIG. 1 and a conventional image forming apparatus.

The horizontal axis of the graph of FIG. 3 indicates an elapsed time since copying is started, i.e., since a drum motor, main electricity eliminating light and a charging bias are turned on, and the vertical axis indicates a surface potential of the photosensitive drum detected by a potential sensor.

In the comparative example, a certain degree of time is required for the photosensitive drum potential to be stabilized since the charging bias is turned on.

After receiving an instruction to form an image, although it is preferable to output an image earlier, the image forming apparatus cannot shift to the potential control process immediately if a photosensitive drum such as an a-si photosensitive drum is used, and a first copying time is extended.

Thus, in this embodiment, an mount of light of the main electricity eliminating light irradiating apparatus 8 is made larger than that during image formation for first one round of the photosensitive drum 1 after starting rotation upon receiving an instruction to form an image, whereby a potential of the photosensitive drum is stabilized immediately.

The main electricity eliminating light irradiating apparatus 8 used in this embodiment is an LED with a central light emitting wavelength of 660 nm, which is controlled by amount of light controlling means to emit light of 10 [1x·s] during image formation and 24 [1x·s] in the process prior to potential control or potential correction with respect to the photosensitive drum rotating at a speed of 150 mm/sec.

Control of the amount of emitted light is switched based on a signal sensed by photosensitive drum position detecting means (not shown). At this point, attention should be paid because, if the amount of light is switched before the photosensitive drum completes a full rotation, a nipple effect of the potential may occur.

Since an a-Si photosensitive drum has large dark attenuation, it is desirable to minimize the amount of light of the main electricity eliminating light irradiating apparatus 8 as much as possible in order to efficiently obtaining a required potential.

On the other hand, since the more the amount of light of the electricity eliminating light irradiating apparatus 8 is, the more a drum memory by residual light carriers according to image exposure tends to be improved, the amount of light of the electricity eliminating light irradiating apparatus 8 is generally set at a minimum amount that is sufficient for the drum memory to be in an acceptable level. In this embodiment, the appropriate amount of light was 10 [1x·s].

However, since the light carriers are gradually getting close to a saturated state if light is emitted in an appropriate amount over the entire potential control process, a potential is gradually decreased. Thus, as in this embodiment, the main electricity eliminating light irradiating apparatus 8 is caused to emit light with an amount of light stronger than an appropriate amount of light only for one initial round of the photosensitive drum to saturate the light carriers at one time, whereby a potential can be immediately stabilized.

A configuration of the image forming apparatus of this embodiment will now be described in detail with reference to FIG. 1. The developing unit used in this embodiment is provided with a rotating sleeve 15 containing a fixed magnet roll 14 and carries developer in a developing container 17 to a developing portion by coating it on the sleeve 15 in a thin layer using the blade 18.

An interval between the sleeve 15 and the photosensitive drum is set at 500 $\mu$m and a carrying amount of developer on the sleeve 15 is set at 40 mg/cm$^2$. In this case, the sleeve 15 is rotating at the peripheral speed of 150 mm/sec in the direction indicated by an arrow.

The developer is two component developer, in which toner with negative chargeability of 8 $\mu$m and a magnetic carrier with positive chargeability of 50 $\mu$m are mixed at a weight toner density of 5%.

The toner density is controlled by an optical toner density sensor (not shown), and toner in a toner hopper 20 is supplied by a supply roller 23.

The developer in the container is equally agitated by agitating members 21 and 22. A developing bias obtained by superimposing a variable direct current voltage Vdc on an alternating electric field of 2 kVpp and 2 kHz is applied to the sleeve 15 from a power source S2. The developer coated in a thin layer and carried to the developing portion contributes to development on the photosensitive drum 1 by an electric field according to the above-mentioned AC+DC voltage.

A magnetic brush charger 2 is provided with a rotatable sleeve 30 and a magnet roller 31 secured in the sleeve 30. A voltage obtained by superimposing an alternating electric field of 400 Vpp and 1 kHz on a variable direct current voltage Vc is applied to the sleeve 30 from a power source S1. A charging bias is effective in improving chargeability and preventing a positive ghost by acting on the alternating electric field.

Magnetic particles are held on the sleeve 30 by magnetic force of constraint of the magnet roller 31. A thickness of a layer of the magnetic particles is regulated by a blade 32 whose interval with the sleeve 30 is set at 700 $\mu$m and the magnetic particles contact the photosensitive drum 1. Further, the sleeve 30 is rotating in the direction indicated by an arrow at the speed of 200 mm/sec.

A carrying amount of magnetic particles on the sleeve 30 at a time when magnetic particles do not contact the photosensitive drum is 170 mg/cm$^2$.

A gap between the a-Si photosensitive drum 1 and the sleeve 30 in the nip is 500 $\mu$m and a magnetic flux density by a magnet on the sleeve 30 of the charging portion is $800\times10^4$ T. As the magnetic particles of the magnetic brush, those with an average diameter of 25 $\mu$m, a resistance value of $5\times10^6$U/cm and saturated magnetization of 200 emu/cm$^2$ are used.

Magnetic brush injection charging is a charging method of causing conductive magnetic particles to contact a member to be charged to directly inject charge therein. Since the injection charging method causes no discharge, compared with roller charging, which uses a discharge phenomenon, and corona charging, it is advantageous in that resistance fluctuation on a surface of a photosensitive drum due to a discharge product does not occur.

The a-Si drum is particularly susceptible to surface resistance fluctuation due to a discharge product. Further, in a very humid environment, lack of sharpness or smudging of an electrostatic latent image tends to occur due to lowering of a surface resistance.

Thus, there is a method of providing a heater in a cylinder of a photosensitive drum to control this phenomenon by heating the photosensitive drum. When the injection charging method is used for such a photosensitive drum, a degree of dependence on the heater can be reduced since there is no influence by a discharge product.

If the injection charging method is used, it is necessary to provide sites for injecting charge by, for example, dispersing conductive particles such as tin oxide on a surface layer in a photosensitive drum using an organic semiconductor On the other hand, an a-Si photosensitive drum inherently includes sufficient charge injection sites on its surface even if specific processing is not applied to it, and has very excellent chargeability.

Figure 4:
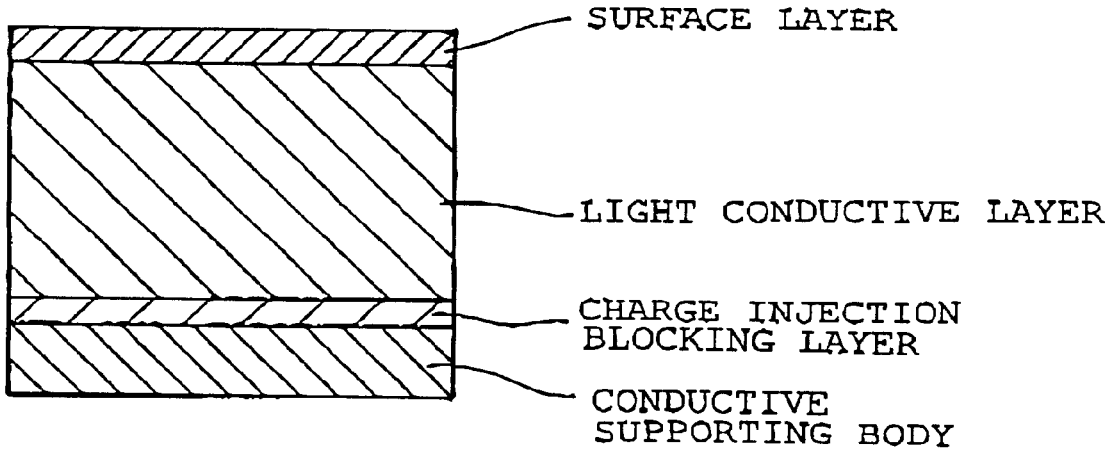
FIG. 4 is a schematic sectional view of an a-Si photosensitive drum provided in the image forming apparatus shown in FIG. 1.

An a-Si photosensitive drum shown in FIG. 4 is used for the photosensitive drum 1 of the present invention. FIG. 4 is a schematic sectional view of an a-Si photosensitive drum provided in the image forming apparatus shown in FIG. 1.

The a-Si photosensitive drum consists of a conductive supporting body, which is an AI cylinder of ϕ60, a charge injection blocking layer, an light conductive layer and a surface layer that are sequentially deposited on the surface of the conductive supporting body.

Here, the charge injection blocking layer is for blocking injection of charge into the light conductive layer from the conductive supporting layer, and the light conductive layer is composed of an amorphous material containing silicon atoms as a main material and shows light conductivity.

Moreover, the surface layer includes silicon atoms and carbon atoms and takes a role of holding an electronic latent image formed on the surface and improving durability of a film.

The a-Si photosensitive drum has an extremely high surface hardness and shows high sensitivity to a long wavelength of a semiconductor laser or the like, and little deterioration due to repeated use is recognized in it. Therefore, it is preferred as an electrophotographic photosensitive drum.

The cleaner 5 consists of a cleaner container, which is provided with a cleaning blade 33, and a screw 34 for carrying toner removed from the photosensitive drum to a waste toner container (not shown).

In the potential control of this embodiment, development contrast potentials $V_{FF}$ to $V_{cont}$ were set to be controlled under a state of 200 V, when Vc was approximately 750 V and Vdc was approximately −250 V.

The potential controlling process or the process prior to potential correction or potential control of this embodiment is simply an example, and an appropriate amount of emitted light or a wavelength of the main electricity eliminating light irradiating apparatus 8 and an amount of emitted light of the main electricity eliminating light irradiating apparatus 8 in the process prior to the potential control are not limited to those indicated in this embodiment depending on, for example, characteristics of an a-Si photosensitive drum or a rotation speed of the photosensitive drum.

In addition, a similar effect can be obtained even if the process prior to potential control is performed not only for one round of a photosensitive drum but also for two or more rounds.

As described above, the main electricity eliminating light irradiating apparatus 8 was caused to emit light with an amount of light larger than an appropriate amount of light before entering the potential control process, whereby t became possible to perform potential control immediately and to shorten a first copying time.

Second Embodiment

Figure 5:
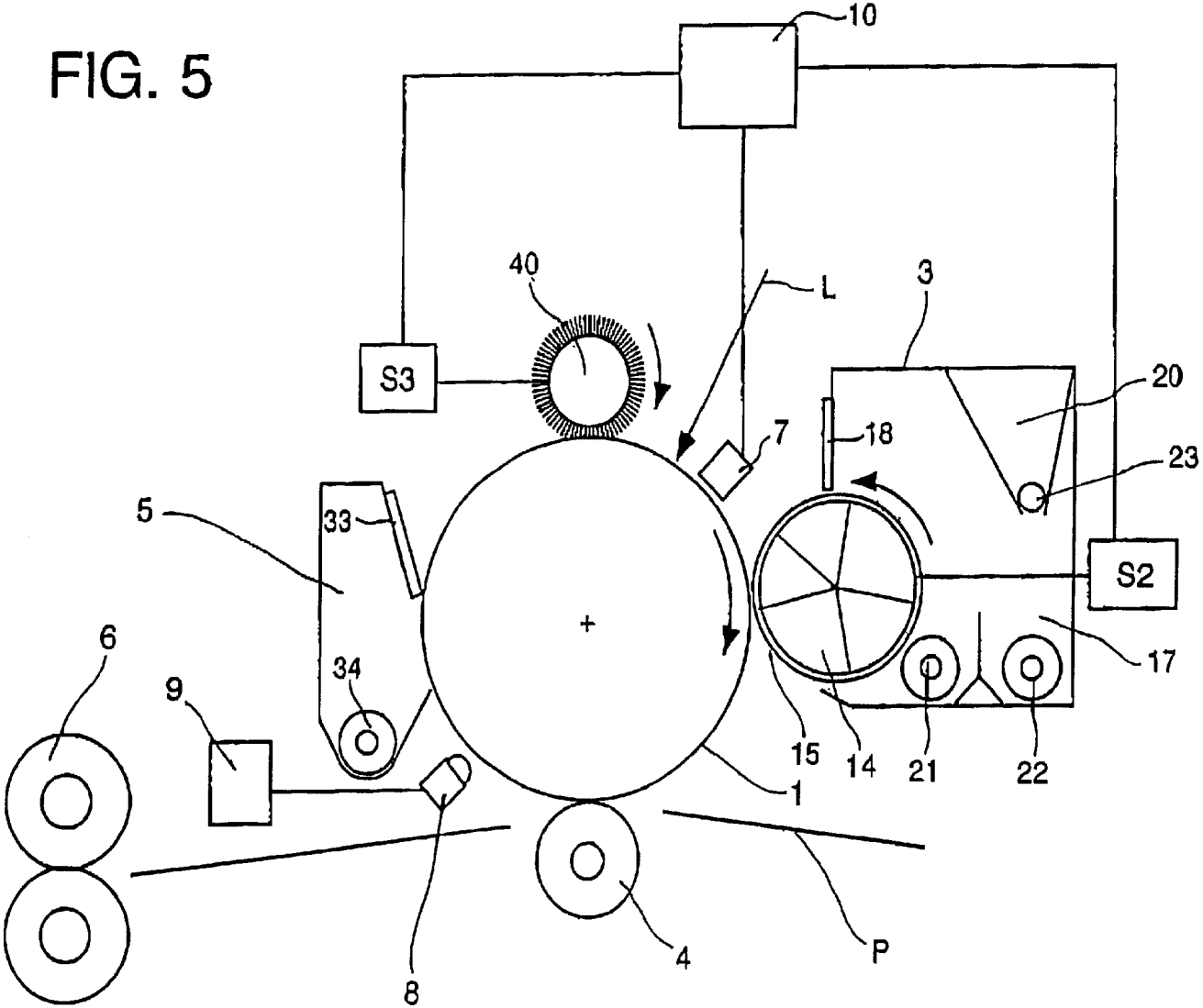
FIG. 5 is a schematic side view of a second embodiment of the image forming apparatus in accordance with the present invention.

A second embodiment of the image forming apparatus in accordance with the present invention will now be described This embodiment is characterized in that a conductive fur brush is used as charging means. A schematic side view of the image forming apparatus of this embodiment is shown in FIG. 5.

Since apparatuses and an image forming process of this embodiment are substantially the same as those in the first embodiment except that a charging apparatus is a fur brush, detailed description will be omitted.

In this embodiment, used as a fur brush 40 is a cylindrical fur brush of a total external diameter of 13 mm with conductive fibers having the length of 3 mm and the resistance value of $1\times10^6$ Ω transplanted in a density of 100,000/inch$^2$ on a core metal having an external diameter of 7 mm.

Further, the fur brush 40 has a nip width of approximately 3 mm between itself and the photosensitive drum 1 and rotates in a counter direction with respect to the photosensitive drum 1, at a speed of 150 mm/sec, where the photosensitive drum 1 also rotates at 150 mm/sec. Moreover, the fur brush 40 is supplied with a voltage from a power source S3 and the voltage is variable by a control apparatus.

Injection charging is also possible with a fur brush by making its electric resistance proper. Although it has a smaller contact density and is inferior in charging uniformity compared with the magnetic brush injection charging, it is used because of its simple configuration.

In this embodiment, an amount of light of the main electricity eliminating light irradiating apparatus 8 is made larger than an appropriate amount of light at the time of the process prior to potential control, whereby it also becomes possible to stabilize a potential immediately and shorten a first copying time.

Third Embodiment

A third embodiment of the image forming apparatus in accordance with the present invention will now be described. This embodiment is characterized in that a corona charger is used as charging means.

Figure 6:
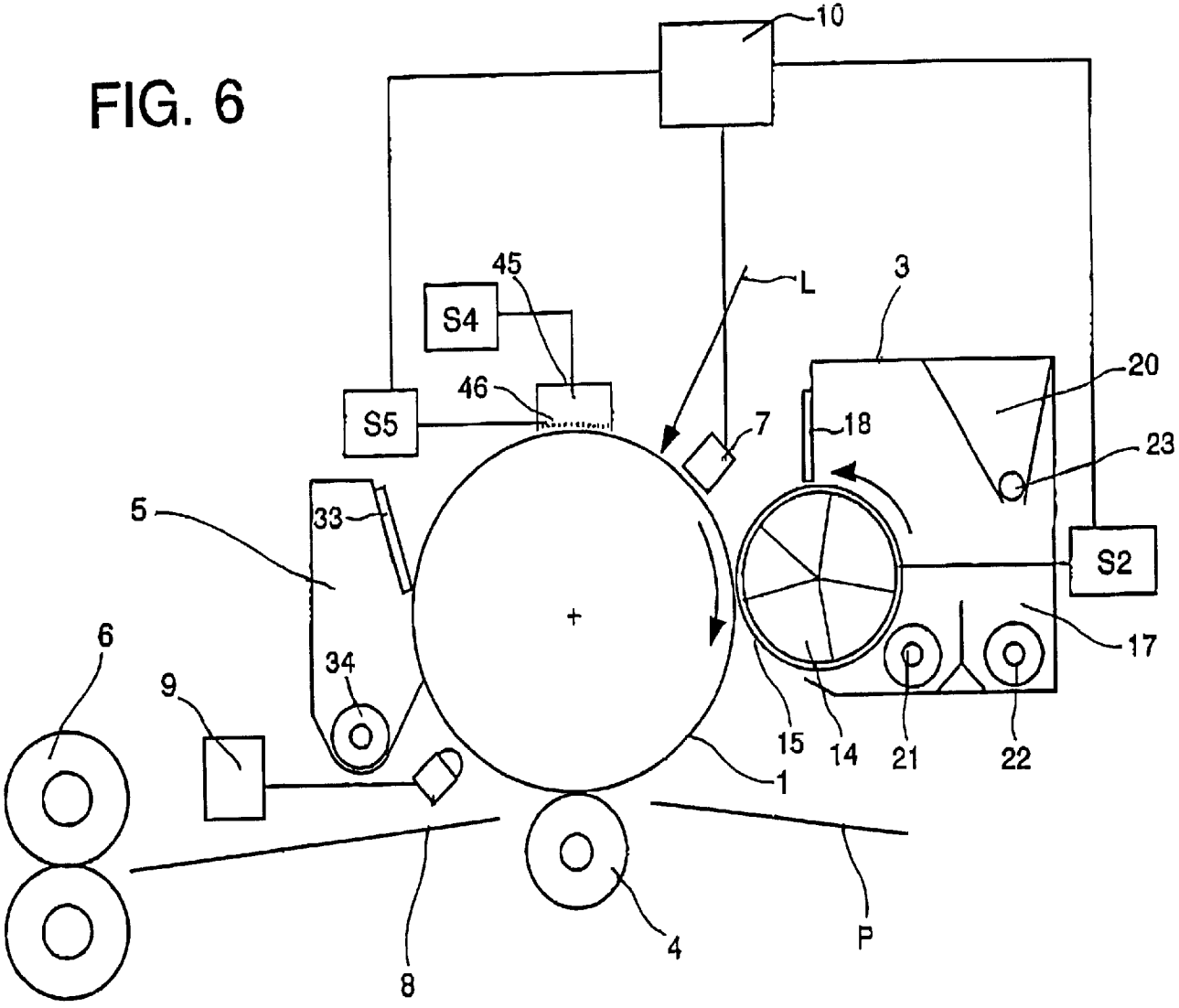
FIG. 6 is a schematic side view of a third embodiment of the image forming apparatus in accordance with the present invention.

A schematic side view of the image forming apparatus of this embodiment is shown in FIG. 6. A heater for a photosensitive drum and a control apparatus for controlling its temperature (not shown in the figure) are provided in the drum.

Since the other apparatuses and an image forming process are similar to those of the first embodiment, description of them in this embodiment will be omitted unless it is necessary.

A charging bias by constant-current control of −1000 μA is applied to a discharge wire 45 from a power source S4. A grid 46 is connected to a power source S5 that is capable of controlling an applied bias and changes this grid applied bias at the time of potential control and potential correction.

Although the corona charging method has disadvantages in that the drum is heated due to an influence of a discharge product such as ozone, it is widely used because of its simple configuration and high durability.

In a charging method for giving charge to a photosensitive drum without contacting it as in this embodiment, an amount of electricity eliminating light is made larger than an appropriate amount of light at the time of the process prior to potential control, whereby it also becomes possible to stabilize a potential immediately and shorten a first copying time.

As described above, according to the present invention, light more than a necessary amount of light is irradiated in order to eliminate ghost due to a light memory by main electricity eliminating light for, for example, at least one round of an image bearing member after starting image formation to cause light carriers trapped in a localized level to be in a steady state and to make it possible to execute potential control immediately after starting copying, whereby a first copying time can be shortened.

In this way, according to the present invention, since an image bearing member is irradiated with an exposure amount larger than a minimum exposure amount for eliminating a light memory in at least a part of an irradiation process such as a process for at least one cycle of an image bearing member, light carriers can be saturated at one time, a potential can be immediately stabilized and at the same time a required potential can be efficiently obtained regardless of dark attenuation of the image bearing member.

Further, a light memory means unevenness of a surface potential of an image bearing member caused by the fact that attenuation of a potential in a light irradiated region is larger than that in a dark region when the light irradiated region and the dark region (not irradiated light region) are simultaneously charged.

Further, since an electricity eliminating light irradiating operation is performed before an initial image forming operation after an image forming apparatus is turned on or between an image forming operation and an image forming operation, an appropriate electricity eliminating operation can be executed for each sheet material.

Further, since a magnetic brush, a fur brush, a corona charger or the like can be used as charging means, its applicable area can be extended.

That is, in the present invention, irradiation of light more than an amount of light required for eliminating ghost due to a light memory is performed by main electricity eliminating light for at least one round of an image bearing member after starting image formation, whereby light carriers from being accumulated gradually is prevented, a steady state of light carriers to be trapped in a localized level is created in one charging, potential control is performed immediately after image formation and a first copying time is shortened.

Thus, the explanation has been made for the embodiments of the present invention. One skilled in the art will appreciate that the present invention can be practiced by other than the preferred embodiments which are presented for the purposes of illustration and not of limitation, and the present invention can be modified in any way within the technical thoughts of the present invention.

What is claimed is:

1. An image forming apparatus comprising:

a photosensitive member;

charging means for charging said photosensitive member;

exposing means for exposing said photosensitive member charged by said charging means so as to form a latent image on said photosensitive member; and light irradiating means for irradiating light on said photosensitive member to eliminate a light memory of said photosensitive member, wherein said light irradiating means irradiates said photosensitive member with an amount of light larger than a minimum amount of light for eliminating a light memory in a period between an image forming operation for developing a latent image formed on said photosensitive member with toner and transferring the toner image to a recording material and an image forming operation with respect to the next recording material.

2. An image forming apparatus according to claim 1, wherein said irradiating means irradiates said photosensitive member with an amount of light larger than an amount of light in a image forming operation for at least one cycle of said photosensitive member.

3. An image forming apparatus according to claim 1, wherein said photosensitive member is an a-Si photosensitive member.

4. An image forming apparatus according to claim 1, wherein said charging means performs a charge injecting method using a magnetic brush.

5. An image forming apparatus according to claim 1, wherein said photosensitive member is a conductive fur brush.

6. An image forming apparatus according to claim 1, wherein said photosensitive member is a corona charger.

7. An image forming apparatus comprising:

a photosensitive member;

charging means for charging said photosensitive member;

exposing means for exposing said photosensitive member charged by said charging means so as to form a latent image on said photosensitive member;

developing means for developing a latent image formed on said photosensitive member with toner;

transferring means for transferring the toner image from the photosensitive member to a recording material; and light irradiating means for irradiating light on said photosensitive member to eliminate a light memory of said photosensitive member, wherein said charging means, said exposing means, said developing means, and said transferring means operate for an image forming operation, and wherein, before an image forming operation, said light irradiating means irradiates said photosensitive member with an amount of light larger than an amount of light in the image forming operation, in response to a turning-on of a power source of the image forming apparatus.

8. An image forming apparatus according to claim 7, wherein said light irradiating means irradiates said photosensitive member with an amount of light larger than an amount of light in image forming operation for at least one cycle of said photosensitive member.

9. An image forming apparatus according to claim 7, wherein said light irradiating means irradiates said photosensitive member with an amount of light larger than an amount of light in image forming operation in a period between an image forming operation with respect to the recording material and an image forming operation with respect to the next recording material.

10. An image forming apparatus according to claim 7, wherein said photosensitive member is an a-Si photosensitive member.

11. An image forming apparatus according to claim 7, wherein said charging means performs a charge injecting method using a magnetic brush.

12. An image forming apparatus according to claim 7, wherein said charging means is a conductive fur brush.

13. An image forming apparatus according to claim 7, wherein said charging means is a corona charger.

14. An image forming apparatus comprising:

a photosensitive member;

charging means for charging said photosensitive member;

exposing means for exposing said photosensitive member charged by said charging means so as to form a latent image on said photosensitive member;

developing means for developing a latent image formed on said photosensitive member with toner;

transferring means for transferring the toner image from the photosensitive member to a recording material; and light irradiating means for irradiating light on said photosensitive member to eliminate a light memory of said photosensitive member;

wherein said charging means, said exposing means, said developing means, and said transferring means operate for an image forming operation, and wherein, before an image forming operation, said light irradiating means irradiates said photosensitive member with an amount of light larger than an amount of light in the image forming operation, in response to receipt by the image forming apparatus of an instruction to start image forming.

15. An image forming apparatus according to claim 14, wherein said light irradiating means irradiates said photosensitive member with an amount of light larger than an amount of light in image forming operation for at least one cycle of said photosensitive member.

16. An image forming apparatus according to claim 14, wherein said light irradiating means irradiates said photosensitive member with an amount of light larger than an amount of light in image forming operation in a period between an image forming operation with respect to the recording material and an image forming operation with respect to the next recording material.

17. An image forming apparatus according to claim 14, wherein said photosensitive member is an a-Si photosensitive member.

18. An image forming apparatus according to claim 14, wherein said charging means performs a charge injecting method using a magnetic brush.

19. An image forming apparatus according to claim 14, wherein said charging means is a conductive fur brush.

20. An image forming apparatus according to claim 14, wherein said charging means is a corona charger.

* * * * *

UNITED STATES PATENT AND TRADEMARK OFFICE

CERTIFICATE OF CORRECTION

PATENT NO. : 6,553,196 B2
DATED : April 22, 2003
INVENTOR(S) : Ryo Inoue

It is certified that error appears in the above-identified patent and that said Letters Patent is hereby corrected as shown below:

Column 1,
Line 64, “hardness” should read -- hardness. --.

Column 5,
Line 4, “only” should be -- deleted.

Column 6,
Line 19, “and” (1st occurrence) should be deleted.
Line 47, “amounts” should read -- amounts. --.

Column 9,
Line 1, “semiconductor” should read -- semiconductor. --.
Line 57, “t” should read -- it --.

Column 10,
Line 63, “light” (1st occurrence) should be deleted.

Column 12,
Line 1, “a” should read -- an --.
Lines 10 and 13, “photosensitive member” should read -- charging means --.

Signed and Sealed this

Fifteenth Day of June, 2004

JON W. DUDAS
*Acting Director of the United States Patent and Trademark Office*